US012655700B2

(12) United States Patent
Robicheaux et al.

(10) Patent No.: US 12,655,700 B2
(45) **Date of Patent: *Jun. 16, 2026**

(54) METHOD AND APPARATUS FOR SETTING DOWNHOLE PLUGS AND OTHER OBJECTS IN WELLBORES

(71) Applicant: Grant Prideco, Inc., Houston, TX (US)

(72) Inventors: Michael R. Robicheaux, Breaux Bridge, LA (US); Trey Falgout, Lafayette, LA (US); M. Joseph Montgomery, Lafayette, LA (US); Tyler Cook, Youngsville, LA (US)

(73) Assignee: GRANT PRIDECO, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/018,001

(22) Filed: Jan. 13, 2025

(65) Prior Publication Data

US 2025/0146373 A1 May 8, 2025

Related U.S. Application Data

(63) Continuation of application No. 18/318,320, filed on May 16, 2023, now Pat. No. 12,221,845, which is a (Continued)

(51) Int. Cl.
*E21B 23/04* (2006.01)
*E21B 33/12* (2006.01)

(52) U.S. Cl.
CPC ..... *E21B 23/042* (2020.05); *E21B 23/0414* (2020.05); *E21B 33/12* (2013.01)

(58) Field of Classification Search
CPC .... E21B 23/065; E21B 23/04; E21B 23/0414; E21B 23/06; E21B 33/1295
See application file for complete search history.

(56) References Cited

U.S. PATENT DOCUMENTS 2,784,790 A 3/1957 Boer et al.
2,799,343 A 7/1957 Conrad
(Continued)

FOREIGN PATENT DOCUMENTS

CA 3050712 A1 7/2018
WO WO2022256454 A1 12/2022

OTHER PUBLICATIONS

Office Action dated Dec. 7, 2023, for U.S. Appl. No. 18/318,320 (10 p.).

(Continued)

*Primary Examiner* — Kipp C Wallace
(74) *Attorney, Agent, or Firm* — CONLEY ROSE, P.C.

(57) ABSTRACT

A gas operated tool for setting a downhole device in a wellbore includes a pressure sub having a first end, a second end, and an inner chamber defining a volume. The inner chamber is configured to receive a power charge. In addition, the tool includes a mandrel operationally attached to the second end of the pressure sub. Further, the tool includes a setting sleeve slidably disposed on the mandrel. The setting sleeve is configured to alternate between a first running position and a second setting position when axial force is applied to the setting sleeve. Still further, the tool includes a dampening assembly coupled to the setting sleeve. The dampening assembly is configured to regulate the axial force applied to the setting sleeve. The dampening assembly includes a housing having an aperture and defining an inner space, dampening material disposed within the inner space, and a plug configured to prevent the dampening material from flowing through the aperture toward the pressure sub, while allowing gas generated by combustion of the power charge to pass through the aperture toward the setting sleeve.

35 Claims, 7 Drawing Sheets

Related U.S. Application Data continuation of application No. 17/699,891, filed on Mar. 21, 2022, now Pat. No. 11,674,361, which is a continuation-in-part of application No. 15/930,928, filed on May 13, 2020, now Pat. No. 11,280,143.

(60) Provisional application No. 62/847,639, filed on May 14, 2019.

(56) References Cited

U.S. PATENT DOCUMENTS 2,839,142 A 6/1958 Huber
3,002,559 A * 10/1961 Hanes ..... E21B 23/065 166/123
3,024,843 A 3/1962 Dean
3,026,939 A * 3/1962 Sweetman ..... E21B 23/0411 166/212
3,094,166 A * 6/1963 Mccullough ..... E21B 23/065 166/123
3,135,327 A * 6/1964 Hanes ..... E21B 23/065 166/120
3,138,207 A 6/1964 Peppers
3,160,209 A * 12/1964 Bonner ..... E21B 23/065 92/9
3,220,480 A * 11/1965 Myers ..... E21B 23/065 166/120
3,314,479 A * 4/1967 Mccullough ..... E21B 23/065 166/182
3,762,470 A 10/1973 Eggleston
3,800,876 A 4/1974 Eggleston
3,822,902 A * 7/1974 Maurer ..... F16L 15/003 285/94
4,429,741 A 2/1984 Hyland
5,221,214 A * 6/1993 Martin ..... E21B 17/0285 439/191
5,311,947 A * 5/1994 Kent ..... E21B 33/043 166/348
5,396,951 A 3/1995 Ross
5,845,669 A * 12/1998 Ross ..... E21B 34/063 137/68.3
8,534,367 B2 * 9/2013 Carisella ..... E21B 23/0412 166/381
8,973,657 B2 3/2015 Miller et al.
8,991,505 B2 3/2015 Flekenstein et al.
9,464,495 B2 10/2016 Picciott et al.
9,771,769 B2 9/2017 Baker et al.
9,810,035 B1 11/2017 Carr et al.
10,066,643 B2 9/2018 Coppedge et al.
10,246,961 B2 4/2019 Robertson et al.
10,392,888 B2 8/2019 Robertson et al.
10,443,331 B1 10/2019 Andres et al.
10,808,480 B2 10/2020 Hern et al.
11,015,408 B2 * 5/2021 Coon ..... E21B 23/0414
2007/0089911 A1 * 4/2007 Moyes ..... E21B 7/007 175/93
2015/0308236 A1 * 10/2015 LaGrange ..... E21B 23/065 166/153
2016/0053561 A1 2/2016 Carr
2016/0237797 A1 8/2016 Arizmendi, Jr. et al.
2019/0106956 A1 4/2019 Wells
2019/0106959 A1 4/2019 Wells
2019/0368293 A1 12/2019 Covalt
2020/0018132 A1 1/2020 Ham et al.
2020/0112782 A1 4/2020 Kargus, IV et al.
2020/0115979 A1 4/2020 Mickey
2020/0157916 A1 5/2020 Hofman et al.
2021/0087897 A1 * 3/2021 Covalt ..... E21B 23/0415
2022/0034181 A1 2/2022 Coronado
2022/0112782 A1 4/2022 Rosenthal
2022/0127919 A1 4/2022 Gleason
2022/0282585 A1 9/2022 Zakharia et al.
2022/0298878 A1 9/2022 Mickey et al.
2023/0175333 A1 6/2023 Crow et al.

OTHER PUBLICATIONS

Response to Office Action dated Dec. 7, 2023, for U.S. Appl. No. 18/318,320; Response filed Apr. 4, 2024 (18 p.).
Final Office Action dated Jul. 1, 2024 for U.S. Appl. No. 18/318,320 (10 p.).
Response to Final Office Action dated Jul. 1, 2024 for U.S. Appl. No. 18/318,320; Response filed Jul. 30, 2024 (14 p.).
Advisory Action dated Aug. 20, 2024 for U.S. Appl. No. 18/318,320 (3 p.).
Response to Final Office Action dated Jul. 1, 2024 for U.S. Appl. No. 18/318,320; Response filed Oct. 1, 2024 (13 p.).
Notice of Allowance dated Oct. 10, 2024 for U.S. Appl. No. 18/318,320 (8 p.).
Canadian Office Action dated Jul. 30, 2025, for Canadian Application No. 3,081,120 (5 p.).

* cited by examiner

METHOD AND APPARATUS FOR SETTING DOWNHOLE PLUGS AND OTHER OBJECTS IN WELLBORES

CROSS-REFERENCE TO RELATED APPLICATIONS

This application is a continuation of U.S. patent application Ser. No. 18/318,320 filed May 16, 2023 and entitled "Method and Apparatus for Setting Downhole Plugs and Other Objects in Wellbores," which is a continuation of U.S. patent application Ser. No. 17/699,891 filed Mar. 21, 2022 and entitled "Method and Apparatus for Setting Downhole Plugs and Other Objects in Wellbores," which is a continuation-in-part of U.S. patent application Ser. No. 15/930,928 filed May 13, 2020 and titled "Method and Apparatus for Setting Downhole Plugs and Other Objects in Wellbores," which claims priority to U.S. patent application Ser. No. 62/847,639 filed May 14, 2029 and entitled "Method and Apparatus for Setting Downhole Tools and Other Equipment in Wellbores," each of which is hereby incorporated herein by references in its entirety for all purposes.

STATEMENT REGARDING FEDERALLY SPONSORED RESEARCH OR DEVELOPMENT

Not applicable.

BACKGROUND

The present invention pertains to a setting tool that can be used to set plugs and other downhole equipment within wellbores. More particularly, the present invention pertains to a compact and cost-efficient setting tool that can be conveyed via wireline for setting downhole tools and other equipment with wellbores.

Wells are typically drilled into the earth's crust using a drilling rig or other similar equipment. After a section of wellbore has been drilled to a desired depth, a string of pipe known as casing is typically conveyed into said well and cemented in place. The casing is often installed to provide structural integrity to the wellbore and to keep geologic formations isolated from one another.

In some applications, a wireline tool string may be run into the wellbore after the casing has been installed in a well. Although many different configurations are possible, the wireline tool string may include a downhole plug that may be set within the inner bore of the casing string at a desired location in the wellbore, as well as a setting tool for setting said downhole plug. Generally, such a plug is used to isolate one portion of a wellbore from another. Although this operation is commonly used in many different operations, such wellbore plugs are commonly used in connection with hydraulic fracturing operations.

Conventional downhole wireline setting tools (for example, a "Baker 20") are long, complex, and require multiple personnel to handle. Thus, it would be beneficial to have a downhole wireline setting tool that is shorter and lighter than conventional setting tools. Further, the setting tool should beneficially have less components, be capable of being redressed and reused more quickly, and be easier to operate than conventional wireline setting tools.

SUMMARY

The present invention comprises a wireline conveyed, gas driven setting tool designed to set downhole tools, such as fracturing ("frac") plugs, zone isolation plugs, bridge plugs, cement retainers, and packers. The setting tool of the present invention is functioned by igniting a power charge inside a firing head. As said power charge burns, the combustion generates gas that acts upon a piston area to stroke setting components of the apparatus.

The setting tool of the present invention generally comprises pressure sub, upper sleeve member, lower sleeve member, central tension mandrel, and tension mandrel adapter. In a preferred embodiment, the central longitudinal axes of each of said pressure sub, upper sleeve member, lower sleeve member and central tension mandrel are all oriented substantially parallel to each other. The lower sleeve member is secured to upper sleeve member which, in turn, is secured against movement along the length of central tension mandrel using at least one shear screw (or pin).

The setting tool is functioned by selectively igniting a power charge inside of a pressure chamber formed within said pressure sub. As the power charge burns, it generates gas that acts upon a piston area to shear said shear screw(s) and stroke the setting tool. A dampening medium or media, as well an optimized flow area at or near the distal end of the setting tool, act to slow or regulate the setting stroke. When stroked, said upper sleeve member and lower sleeve member are displaced along the longitudinal axis of said tension mandrel, thereby causing an attached downhole plug or other object to be set according to a process understood by those in the art that, for clarity and conciseness, is not described in detail in this disclosure.

The setting tool of the present invention is shorter and lighter than conventional setting tools. Further, the setting tool of the present invention has less components, can be redressed in a fraction of the time compared to conventional setting tools, and can be efficiently operated by a single person. Unlike many conventional setting tools, the setting tool of the present invention does not require oil to dampen setting force. As a result, the setting tool of the present invention requires less parts and seal areas (potential leak paths), while eliminating risk for human error (that is, forgetting the oil entirely or loading the incorrect volume of oil).

The setting tool of the present invention utilizes a dampening assembly within said setting tool to slow the setting stroke of the tool; such dampening effect is frequently beneficial when setting tools and other equipment downhole within a wellbore. Additionally, an optimized flow area at or near the bottom or distal end of the setting tool also acts to slow said setting stroke.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION

While the present invention will be described with reference to preferred embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting. As used herein, the term "sub" is intended to generically refer to a section or a portion of a tool string. While a sub may be modular and use threaded connections, no particular configuration is intended or implied by the use of the term sub.

Figure 1:
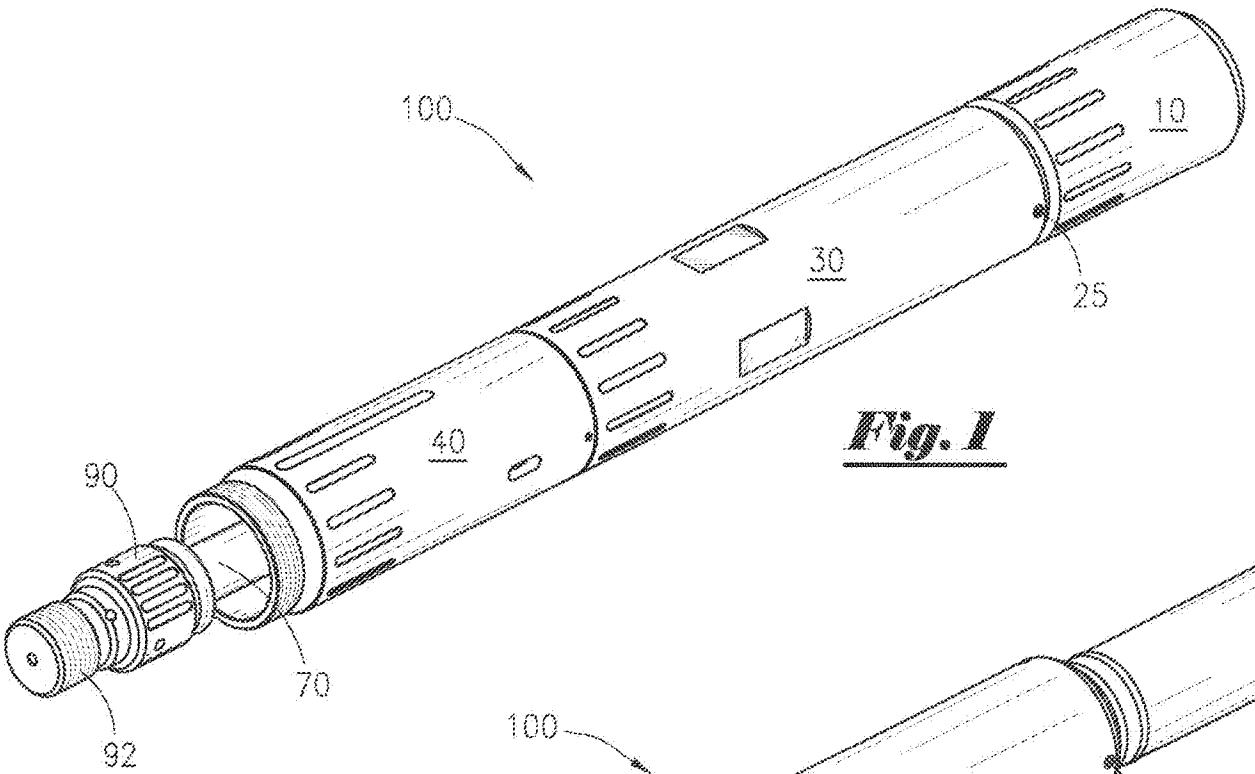
FIG. 1 depicts a side perspective view of the setting tool apparatus of the present invention in a retracted or "unstroked" configuration.

FIG. 1 depicts a side perspective view of setting tool apparatus 100 of the present invention in a retracted or "un-stroked" configuration. As depicted in FIG. 1, said setting tool apparatus 100 generally comprises pressure sub 10, upper sleeve member 30, lower sleeve member 40, central tension mandrel 70 and tension mandrel adapter 90. In a preferred embodiment, the central longitudinal axes of each of said pressure sub 10, upper sleeve member 30, lower sleeve member 40 and central tension mandrel 70 are all oriented substantially parallel to each other. In the configuration depicted in FIG. 1, lower sleeve member 40 is secured to upper sleeve member 30 which, in turn, is secured against movement along the length of central tension mandrel 70 using at least one shear screw (or pin) 25.

Figure 2:
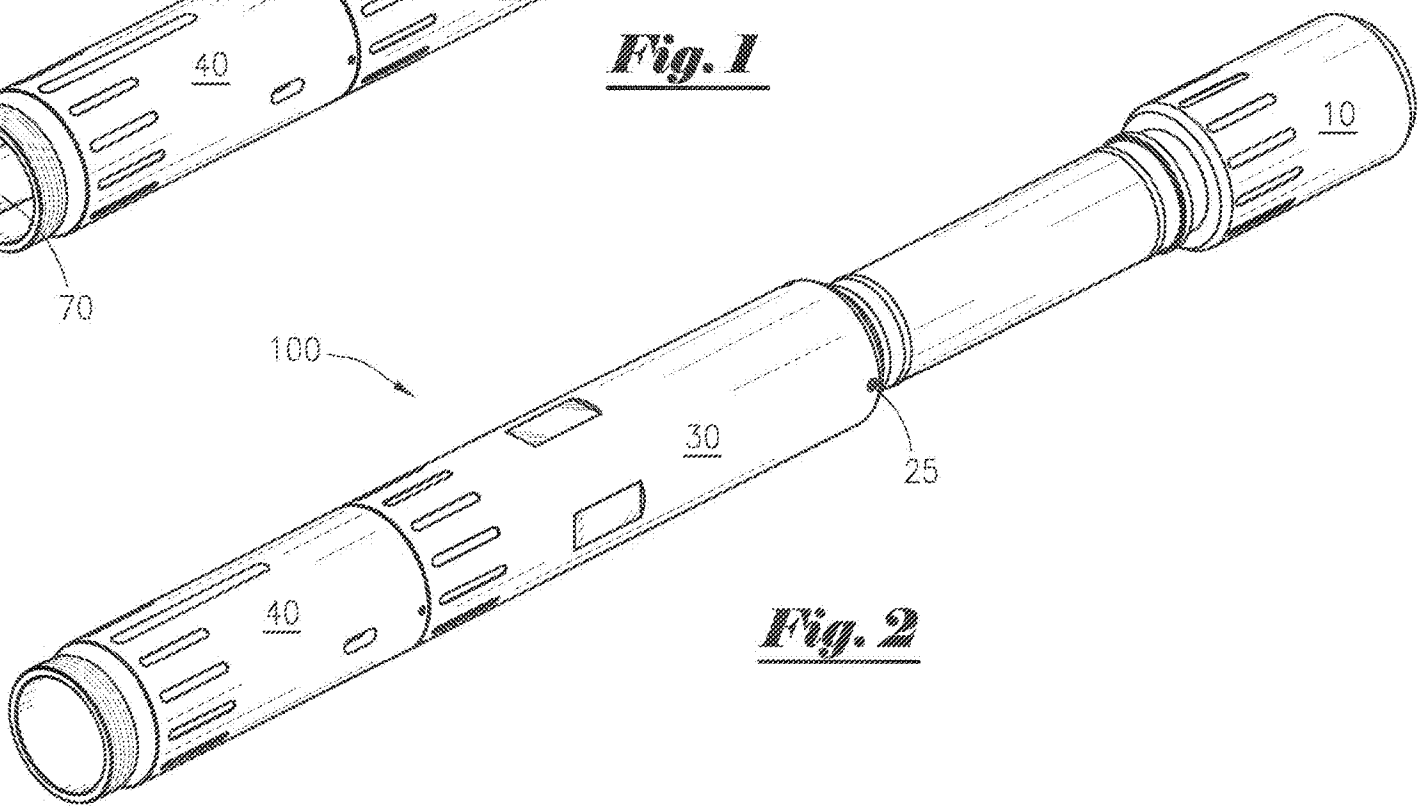
FIG. 2 depicts a side perspective view of the setting tool apparatus of the present invention in an extended or "stroked" configuration.

FIG. 2 depicts a side perspective view of setting tool apparatus 100 of the present invention in an extended or "stroked" configuration. As depicted in FIG. 2, said at least one shear screw 25 has been sheared. As a result, upper sleeve member 30 and attached lower sleeve member 40 are capable of movement along the length of central tension mandrel 70. In the configuration depicted in FIG. 2, said upper sleeve member 30 and lower sleeve member 40 are displaced along the longitudinal axis of said tension mandrel 70, thereby exposing at least a portion of body section 13 of pressure sub 10.

Figure 3:
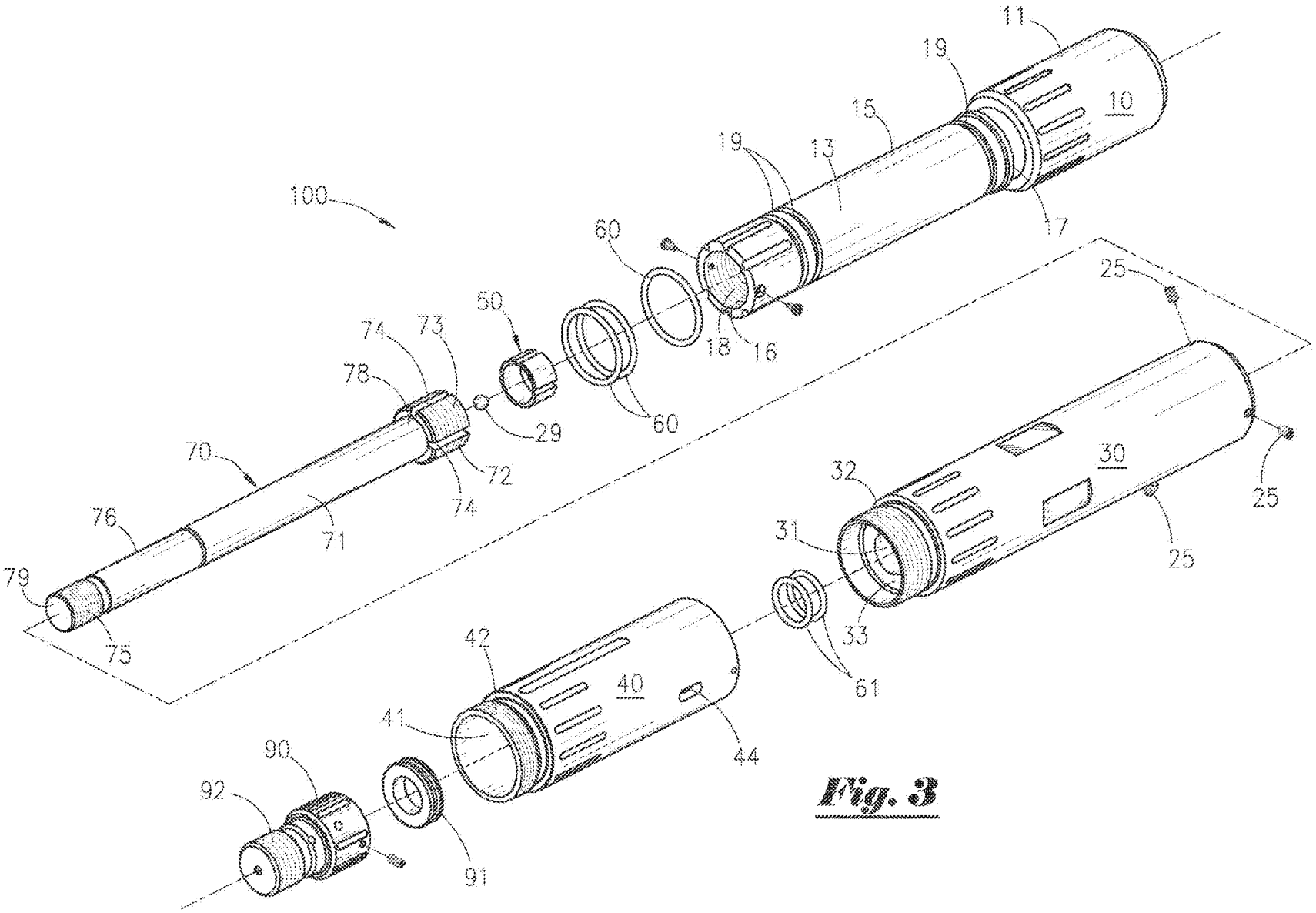
FIG. 3 depicts a side perspective and exploded view of the setting tool apparatus of the present invention.

FIG. 3 depicts a side perspective and exploded view of setting tool apparatus 100 of the present invention. Setting tool apparatus 100 generally comprises pressure sub 10, upper sleeve member 30, lower sleeve member 40, central tension mandrel 70 and tension mandrel adapter 90. In a preferred embodiment, the central longitudinal axes of each of said pressure sub 10, upper sleeve member 30, lower sleeve member 40, central tension mandrel 70 and tension mandrel adapter 90 are all oriented substantially parallel to each other.

Pressure sub 10 generally comprises upper connection member 11 and body section 13. In a preferred embodiment, said upper threaded connection member 11 comprises a female or "box-end" threaded connection having internal threads (not visible in FIG. 3) that is configured for operational attachment to a conventional wireline or other connection adapter. However, it is to be observed that other types of connection members having different thread types or other connection means can be employed without departing from the scope of the present invention. By way of illustration, but not limitation, a pin-end threaded connection or other attachment means can be employed.

As depicted in FIG. 3, pressure sub 10 further comprises body section 13 defining outer surface 15. Central through bore 18 extends through said pressure sub 10. Lower connection threads 16 are disposed near the lower or distal end of body section 13; in the embodiment depicted in FIG. 3, said lower connection threads 16 comprise internal threads disposed on the inner surface of central through bore 18. At least one circumferential groove 19 extends around body section 13 and is configured to receive elastomeric sealing elements, such as O-rings 60. Further, radial extension ring 17 extends at least partially around the circumference of, and has a greater outer diameter than, said body section 13.

Central tension mandrel 70 comprises an elongate and substantially rigid member having a first end 78, second end 79 and body section 71 there between. In a preferred embodiment, said body section 71 has a substantially cylindrical shape defining outer surface 76. Lower threads 75 are disposed near second end 79; in the embodiment depicted in FIG. 3, said threads 75 comprise external threads. At least one circumferential step-down or change in outer diameter 76 extends around body section 71 near the lower or distal end of said central mandrel 70.

Central tension mandrel 70 further comprises connection member 72 disposed at or near first end 78 of said central tension mandrel 70. In a preferred embodiment, said connection member 72 has external male threads 73 configured to mate with internal threads 16 of pressure sub 10. Further, at least one elongate flow path 74 (such as a groove or channel) extends through said threads 73. In a preferred embodiment, said at least one flow path 74 comprises a channel oriented substantially parallel to the longitudinal axis of body section 71 and substantially perpendicular to the direction or orientation of said threads 73; however, it is to be observed that said at least flow path can have a different orientation without departing from the scope of the present invention, so long as it permits flow of fluid past said connection member 72. Internal plug 50 having an aperture 51 (not visible in FIG. 3) is operationally attached to connection member 72. Ball 29 is disposed within said internal plug 50 and is configured to selectively block said aperture 51 as more fully described herein.

Upper sleeve member 30 generally comprises a cylindrical member having a through bore 31 extending substantially along the longitudinal axis of said upper sleeve member 30. Similarly, lower sleeve member 40 comprises a cylindrical member having a through bore 41 extending substantially along the longitudinal axis of said lower sleeve member 40. At least one transverse side port 44 extends from said through bore 41 to the external surface of said lower sleeve member 40. Lower threads 42 are disposed at or near the lower or distal end of lower sleeve member 40.

Lower threads 32 are disposed at or near the lower or distal end of said upper sleeve member 30; in a preferred embodiment, said threads 32 are configured to engage with mating threads disposed on the inner surface of central through bore 41 of lower sleeve member 40 (not visible in FIG. 3). In a preferred embodiment, the central longitudinal axes of each of said pressure sub 10, upper sleeve member 30, lower sleeve member 40, central tension mandrel 70 and tension mandrel adapter 90 are all oriented substantially parallel to each other.

Cushion member 91 is received on tension mandrel 70. In a preferred embodiment, said cushion member 91 comprises a resilient or padded material (such as an elastomeric or foam material) configured to lessen or dampen force exerted between members contacting each other. Tension mandrel adapter member 90 is secured at second end 79 of tension mandrel 70 using lower threads 75.

Figure 4:
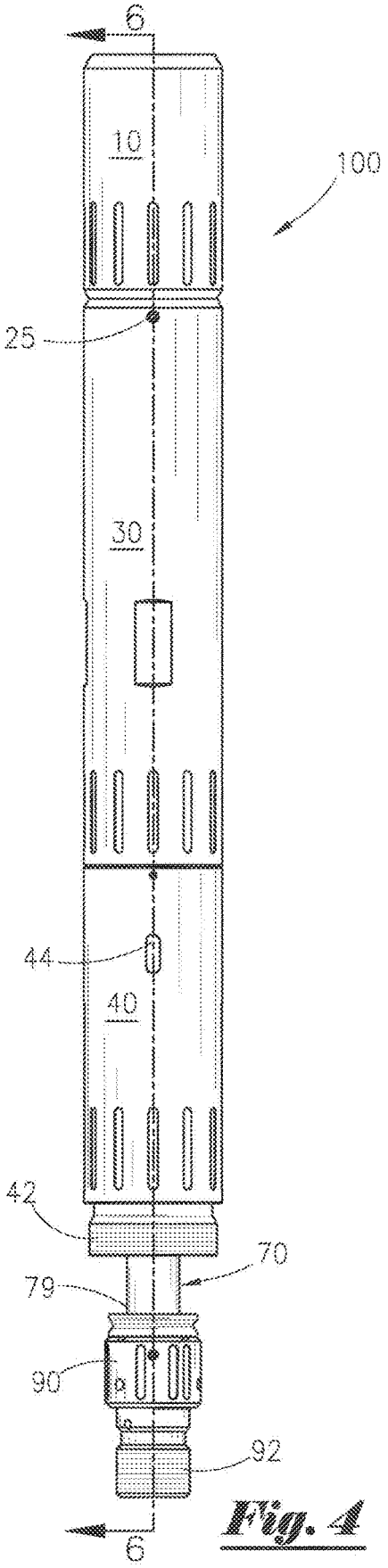
FIG. 4 depicts a side view of the setting tool apparatus of the present invention in a retracted or "un-stroked" configuration.

FIG. 4 depicts a side view of setting tool apparatus 100 of the present invention in a retracted or "un-stroked" configuration. As depicted in FIG. 4, said setting tool apparatus 100 generally comprises pressure sub 10, upper sleeve member 30, lower sleeve member 40, central tension mandrel 70 and tension mandrel adapter 90. Tension mandrel adapter member 90 is secured near the lower or distal end (second end 79) of tension mandrel 70. Lower sleeve member 40 is secured to upper sleeve member 30 which, in turn, is secured against movement along the length of central tension mandrel 70 using at least one shear screw (or pin) 25.

Figure 5:
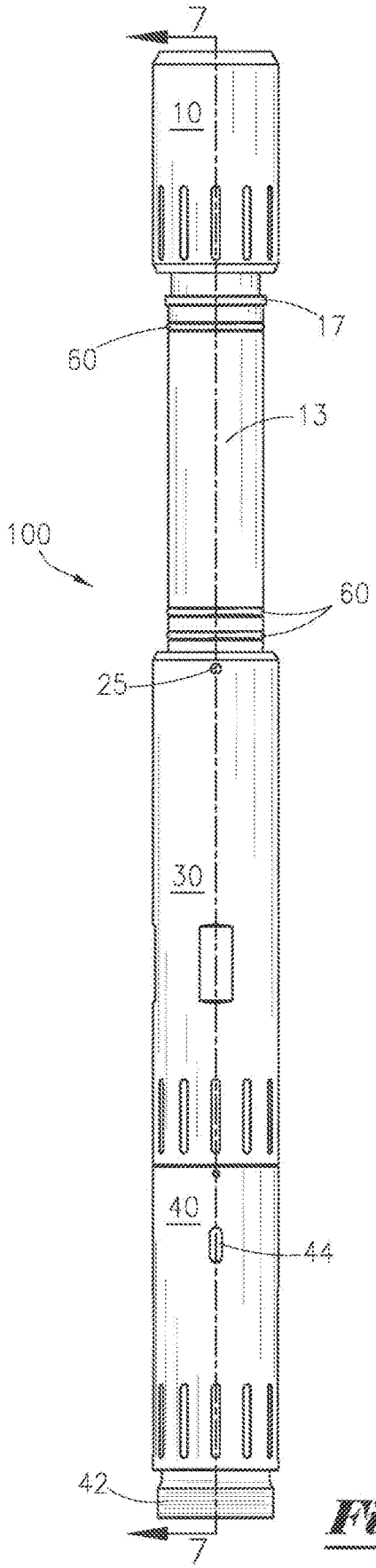
FIG. 5 depicts a side view of the setting tool apparatus of the present invention in an extended or "stroked" configuration.

FIG. 5 depicts a side view of setting tool apparatus 100 of the present invention in an extended or "stroked" configuration. As depicted in FIG. 5, at least one shear screw 25 is sheared or separated and, as such, is not constrained from axial movement by radial extension ring 17 that extends at least partially around the circumference of said body section 13. As a result, upper sleeve member 30 and attached lower sleeve member 40 are capable of movement along the longitudinal axis or length of central tension mandrel 70.

Still referring to FIG. 5, said upper sleeve member 30 and lower sleeve member 40 are displaced along the longitudinal axis of said tension mandrel 70, thereby exposing at least a portion of body section 13 of pressure sub 10. In this configuration, O-rings 60 disposed around said body section 13 are no longer positioned to engage against central bore 31 of upper sleeve member 30. Further, in the configuration depicted in FIG. 5, it is to be observed that lower threads 42 at the distal end of lower sleeve member 40 extend beyond tension mandrel adapter 90 (visible in FIG. 4 but not FIG. 5).

Figure 6A:
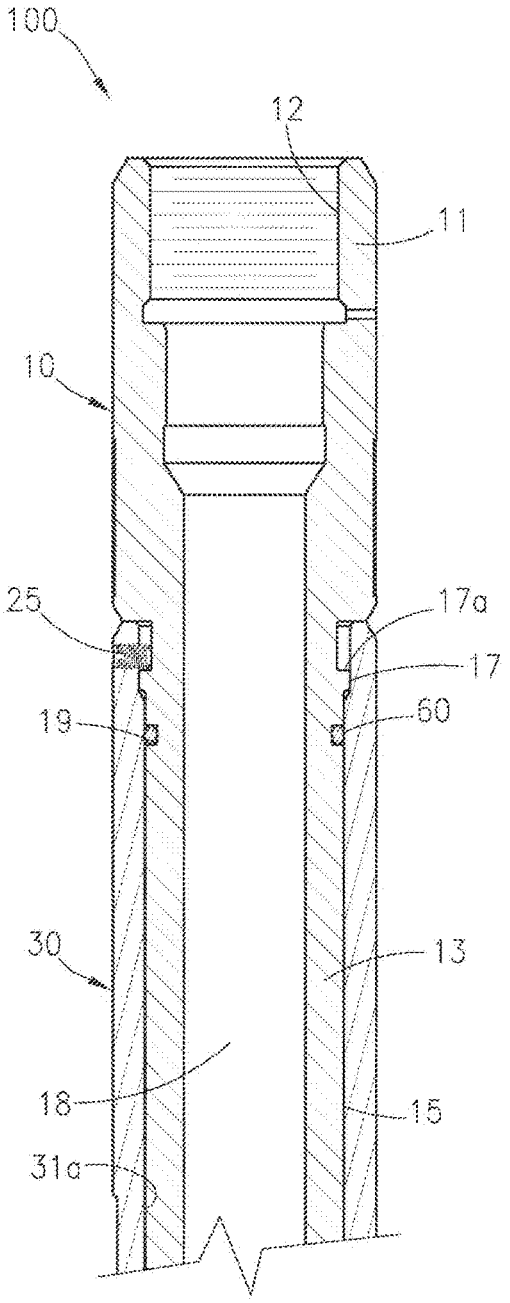
FIG. 6A depicts a first portion of the setting tool apparatus of the present invention along line 6-6 of FIG. 4.
Figure 6B:
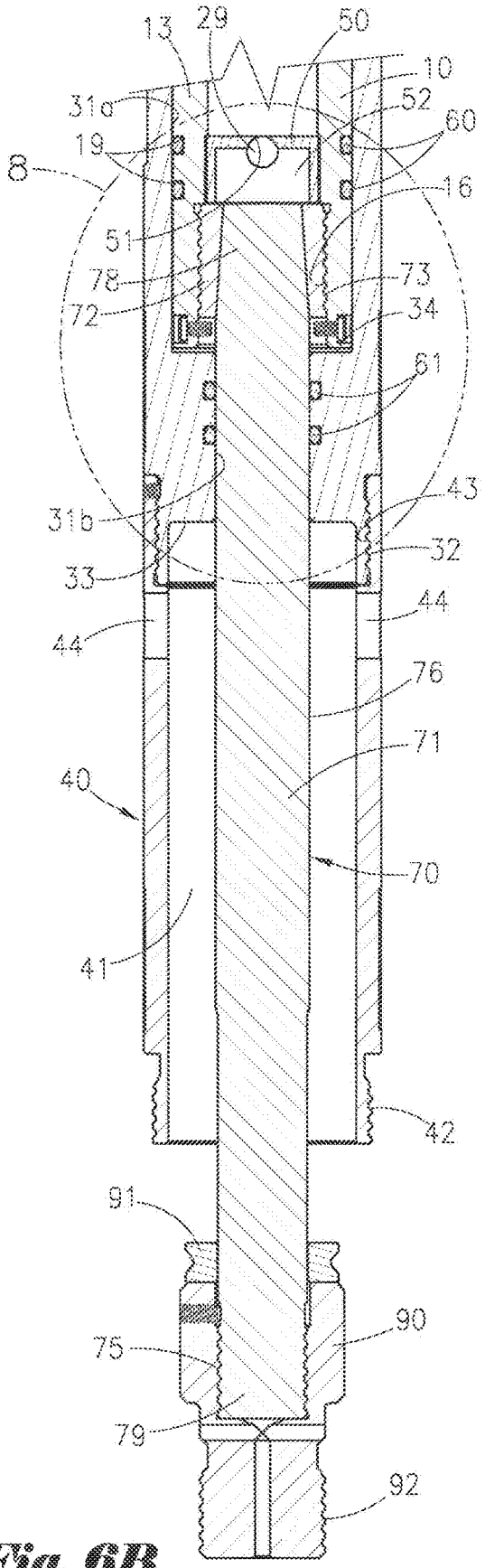
FIG. 6B depicts a second portion of the setting tool apparatus of the present invention along line 6-6 of FIG. 4.

FIG. 6A depicts a first (upper) portion of setting tool apparatus 100 of the present invention along line 6-6 of FIG. 4, while FIG. 6B depicts a second (lower) portion of said setting tool apparatus 100 of the present invention along line 6-6 of FIG. 4. Setting tool apparatus 100 generally comprises pressure sub 10, upper sleeve member 30, lower sleeve member 40, central tension mandrel 70 and tension mandrel adapter 90.

Referring to FIG. 6A, pressure sub 10 generally comprises upper connection member 11 and body section 13. In a preferred embodiment, said upper threaded connection member 11 comprises a female or "box-end" threaded connection having internal threads 12 that are configured for operational attachment to a conventional wireline or other connection adapter.

Still referring to FIG. 6A, pressure sub 10 further comprises body section 13 defining outer surface 15. Central through bore 18 extends through said pressure sub 10, while lower connection threads 16 are disposed near the lower or distal end of body section 13. Elastomeric sealing elements, such as O-rings 60, are disposed within circumferential grooves extending around body section 13; said O-rings 60 engage against inner surface 31*a* of central bore 31 of upper sleeve member 30 in order to form a fluid pressure seal.

Further, radial extension ring 17 extends at least partially around the outer circumferential surface of said body section 13. At least one shear screw 25 is disposed within a transverse bore extending through upper sleeve member 30 and engages against a shoulder surface 17*a* of radial extension ring 17; in this configuration, said at least one shear screw 25 prevents axial movement of upper sleeve member 30 (as well as any operationally attached components) along the longitudinal axis of central tension mandrel 70.

Central tension mandrel 70 comprises an elongate and substantially rigid member having a first end 78, second end 79 and body section 71 defining outer surface 76. Elastomeric sealing elements, such as O-rings 61, are disposed within circumferential grooves extending around body section 71; said O-rings 61 engage against outer surface 76 of central mandrel 70 in order to form a fluid pressure seal in the un-stroked position. In a preferred embodiment, central bore 31 has a smaller ID in the vicinity of O-rings 61 than near O-rings 60.

Central tension mandrel 70 further comprises connection member 72 disposed at or near first end 78 of said central tension mandrel 70. In a preferred embodiment, said connection member 72 has external male threads 73 configured to mate with internal threads 16 of pressure sub 10. Although not visible in FIG. 6B, at least one flow path 74 extends through said threads 73 and permits flow of fluid past connection member 72 as more fully described herein.

Internal plug or housing 50 having aperture 51 is operationally attached to connection member 72. Said internal plug 50 further defines an inner chamber or void 52. Ball 29 is moveably disposed within said inner chamber or void 52 of said internal plug 50, and is configured to selectively seat against said internal plug 50 in order to selectively block or obstruct said aperture 51.

Lower sleeve member 40 comprises a cylindrical member having a through bore 41 extending substantially along the longitudinal axis of said lower sleeve member 40. At least one transverse side port 44 extends from said through bore 41 to the external surface of said lower sleeve member 40, while threads 42 are disposed at or near the lower or distal end of lower sleeve member 40. Threads 32 of upper sleeve member 30 are configured to engage with mating threads 43 disposed on the inner surface of central through bore 41 of lower sleeve member 40. Cushion member 91 is received on tension mandrel 70. Tension mandrel adapter member 90 is secured at second end 79 of tension mandrel 70 using lower threads 75.

Figure 8:
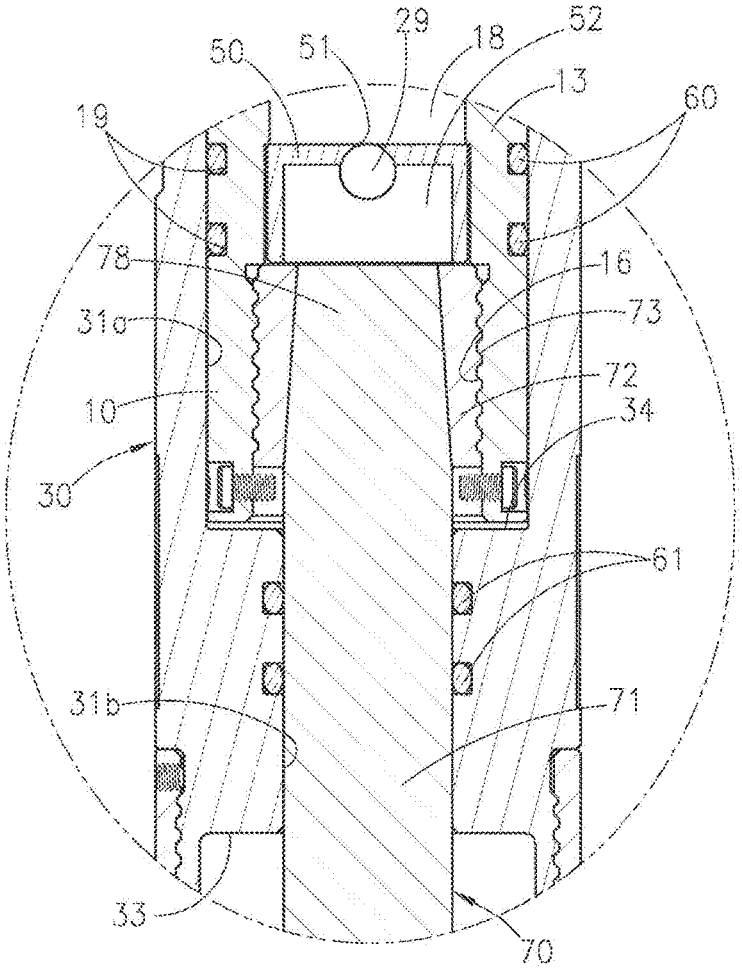
FIG. 8 depicts a detailed view of the highlighted area depicted in FIG. 6B.

FIG. 8 depicts a detailed view of the highlighted area depicted in FIG. 6B. Central bore 18 extends through said pressure sub 10, while lower connection threads 16 are disposed near the lower or distal end of body section 13. Elastomeric sealing elements (O-rings) 60 engage against inner surface 31*a* of central bore 31 of upper sleeve member 30 in order to form a fluid pressure seal. Similarly, elastomeric sealing elements (O-rings 61) extend around body section 71 of tension mandrel 70; said O-rings 61 engage against outer surface 76 of central mandrel 70 in order to form a fluid pressure seal in the un-stroked position.

Connection member 72 is disposed at or near first end 78 of said central tension mandrel 70. Although not visible in FIG. 8, at least one flow path 74 extends through said threads 73 of connection member 72 and permits flow of fluid past said connection member 72 as more fully described herein. Internal plug 50 having aperture 51 defines an inner chamber or void 52. Ball 29 is moveably disposed within said inner chamber or void 52 of said internal plug 50, and is configured to selectively seat against said internal plug 50 in order to selectively block or obstruct aperture 51.

Setting tool 100 of the present invention maintains a fluid pressure that is supplied or energized by pressurized gas. Said fluid pressure is converted into force or kinetic energy used to displace a portion of said setting tool 100 that, in turn, axially displaces outer shifting sleeve component of a separate wellbore device (not shown). Thus, setting tool 100 of the present invention may be used to axially displace or otherwise move, shift, or load a separate wellbore device (not shown), such as a fracturing ("frac") plug, packer, swage, bridge plug, or the like.

Referring to FIGS. 6A and 6B, a power charge is beneficially loaded into central bore 18 of pressure sub 10 which is configured to define a pressure chamber. Setting tool 100 can be operationally connected to a conventional bottom hole assembly of a wireline (such as, for example, a wireline bottom hole assembly that would be used with a "Baker 20" or other conventional setting tool), typically via upper threads 12 of pressure sub 10. Said setting tool 100 can also be connected at its distal end to a plug, packer or other tool to be set downhole within a wellbore using threads 92 of tension mandrel adapter 90 and threads 42 of lower sleeve 40. Thereafter, setting tool 100 of the present invention 10 and the attached device to be anchored within a wellbore are conveyed to a desired depth within said wellbore.

After the aforementioned assembly has been positioned at a desired setting depth within a wellbore, said power charge disposed within bore 18 (also sometimes referred to as a power charge chamber) is selectively ignited, typically by some actuation signal or other triggering action initiated at the surface and conveyed downhole to setting tool 100. As said charge burns, gas is generated and expands within said pressure chamber formed by bore 18. The design and manufacture of suitable power charges and their operation within setting tools of the type described herein is understood by those in the art and, for clarity and conciseness, is described further.

It is to be observed that said power charges may be commercially available, or specifically designed and manufactured for use in connection with setting tool 100 of the present invention. Further, it is to be understood that, in addition to any other ingredients or materials, said power charges may include at least a minimum amount of explosive or propellent material; said minimum amount of explosive or propellent material in said power charge can be expressed, for example, by weight. In a preferred embodiment, said a minimum explosive or propellent weight of said power charge may be in a range between 350 grams and 470 grams for a first size of setting tool 100, or in a range between 440 grams and 480 grams for a second (larger) size of setting tool 100. Additionally, said chamber formed by bore 18 can define a minimum volume for receiving a power charge. In a preferred embodiment, said volume of said chamber defined by bore 18 may be in a range between 14.5 cubic inches and 17.5 for a first size of setting tool 100, or in a range between 19.5 cubic inches and 26.5 cubic inches for a second (larger) size of setting tool 100. Notwithstanding the foregoing, it is to be observed that power charges having different amounts of explosive or propellent material, and setting tools having different sizes of chambers for receiving said power charges, may be employed without departing from the scope of the present invention.

Figure 7A:
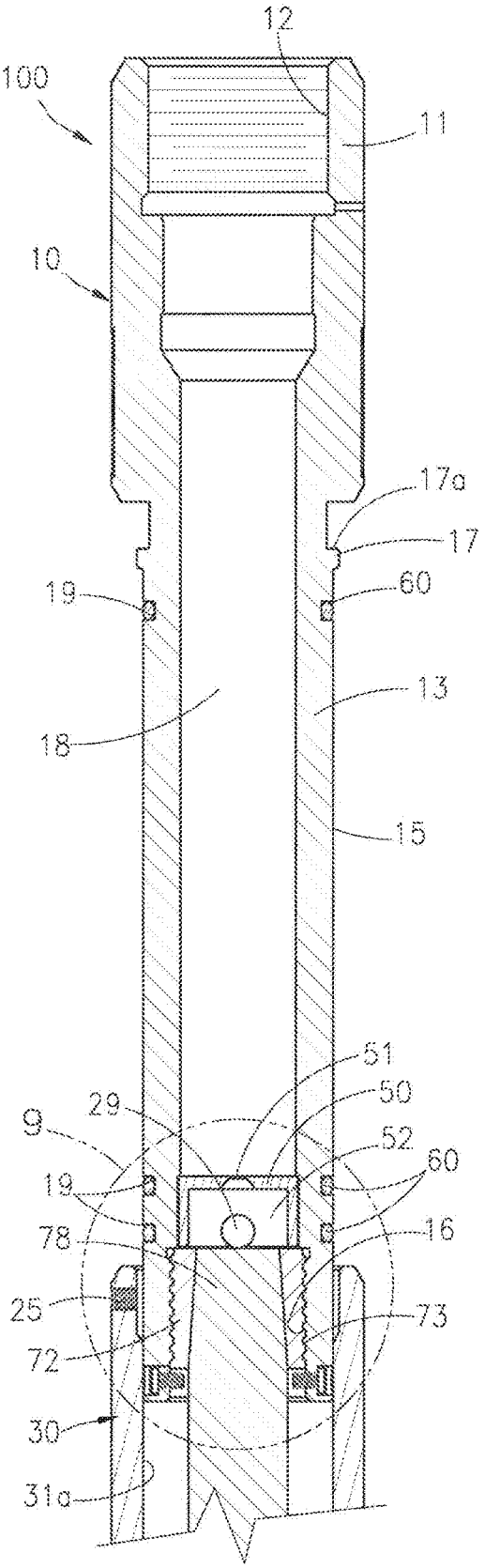
FIG. 7A depicts a first portion of the setting tool apparatus of the present invention along line 7-7 of FIG. 5.
Figure 7B:
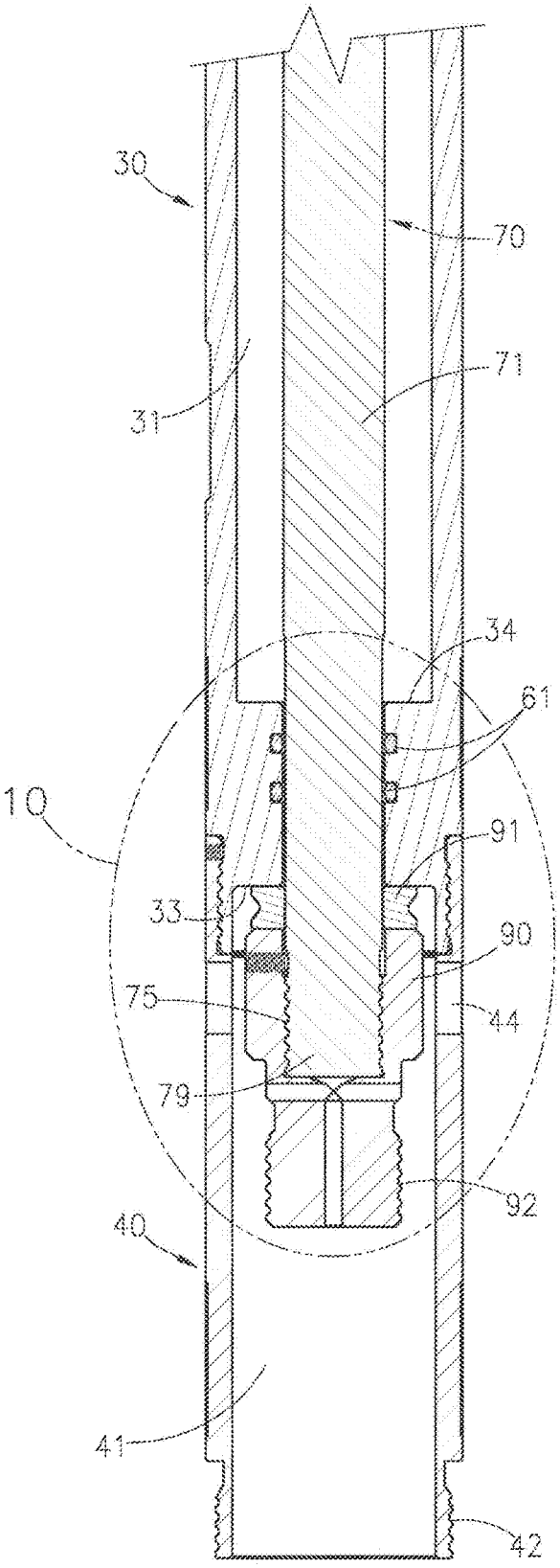
FIG. 7B depicts a second portion of the setting tool apparatus of the present invention along line 7-7 of FIG. 5.
Figure 9:
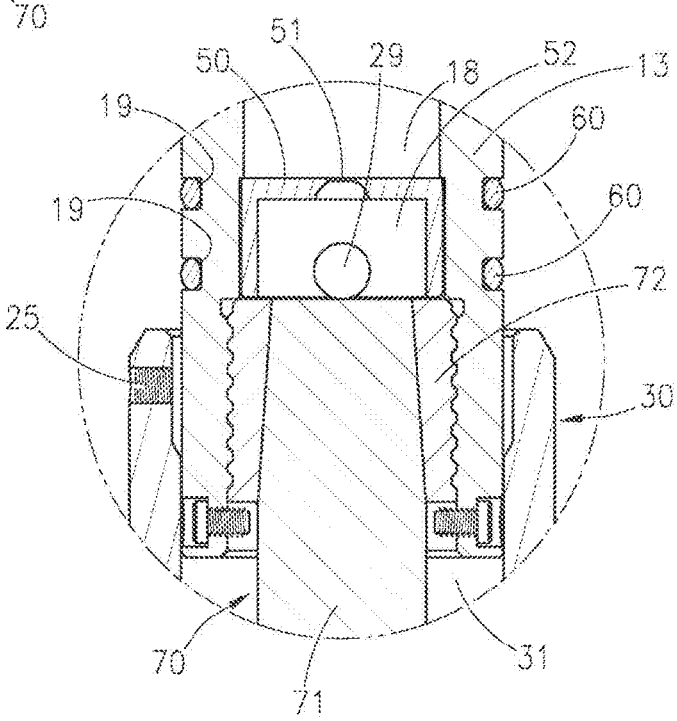
FIG. 9 depicts a detailed view of the highlighted area depicted in FIG. 7A.
Figure 10:
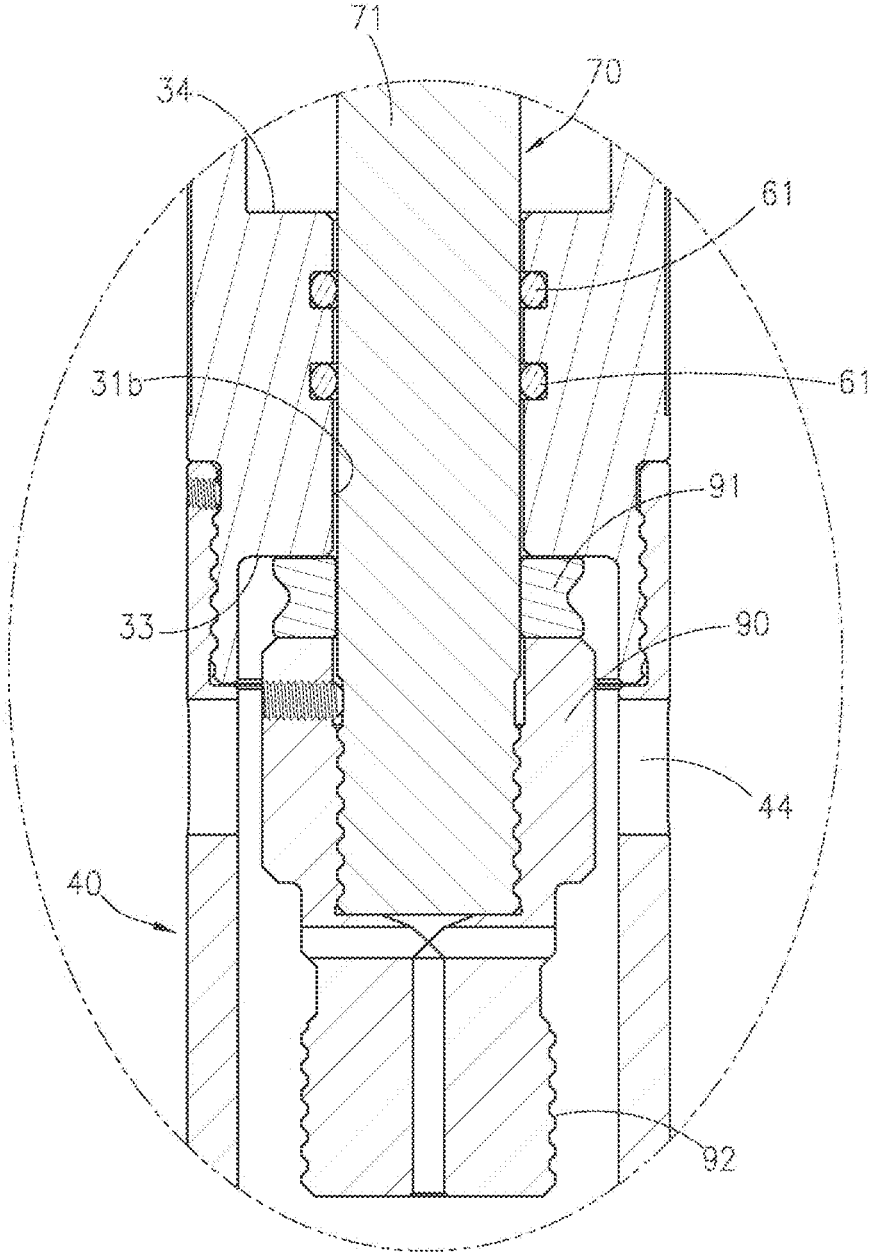
FIG. 10 depicts a detailed view of the highlighted area depicted in FIG. 7B.

FIG. 7A depicts a first (upper) portion of setting tool apparatus 100 of the present invention along line 7-7 of FIG. 5, while FIG. 7B depicts a second (lower) portion of said setting tool apparatus 100 of the present invention along line 7-7 of FIG. 5. FIG. 9 depicts a detailed view of the highlighted area depicted in FIG. 7A. In operation, setting tool 100 may be used to actuate and set a separate well tool (not shown) using a translating assembly well known to those in the art.

In a preferred embodiment, a force dampening assembly is beneficially disposed between said pressure chamber. Said force dampening assembly can comprise an internal plug 50 having a central aperture 51 and defining an inner space 52. Ball 29, as well as dampening material or media, is disposed within said inner space 52 formed by said internal plug 50. In the "running" or pre-stroke configuration, ball 29 is seated against and obstructs aperture 51.

Fluid pressure generated within said pressure chamber (bore 18) exerts force on ball 29, causing said ball 29 to become unseated from the seat formed by aperture 51 of internal plug 50. Said fluid (gas) pressure then forces dampening material or media disposed within inner chamber 52 of internal plug 50 through at least one flow path 74 (such as an elongate groove or flow channel) extending through threads 73 of connection member 72. (Said flow channels are not visible in FIGS. 7A and 7B, but can be seen in FIG. 3). Said flow path(s) 74 are designed to slow the expansion of gas in order to set the downhole tools more smoothly and evenly.

Unlike conventional setting tools which typically comprise some form of flow ports or holes in said pressure chamber (that can become easily clogged or plugged), in a preferred embodiment said optimized flow paths 74 may comprise grooves or channels. Said optimized flow areas permit fluid to flow past said connection member 72 and tension mandrel 70 in a controlled rate. Although other materials can be used without departing from the scope of the present invention, said dampening material or media can comprise a high viscosity material such as grease or other flowable fluid that has a desired resistance to flow.

After a predetermined volume of dampening material or media has passed through said optimized flow paths 74, said dampening material or media then applies pressure to the piston area defined by surface 34 of sleeve member 30. A first set of sealing members comprises elastomeric sealing elements (O-rings) 60 that engage against inner surface 31*a* of central bore 31 of upper sleeve member 30 in order to form a fluid pressure seal. A second set of sealing members comprises elastomeric sealing elements (O-rings 61) that extend around body section 71 of tension mandrel 70; in the un-stroked position (shown in FIGS. 6A and 6B), said O-rings 61 engage against outer surface 76 of central mandrel 70 in order to form a fluid pressure seal. However, it is to be observed that said O-rings 61 only engage and form said seal against the portion of tension mandrel 70 having the larger outer diameter, but not the (lower) portion of said mandrel 70 having the smaller outer diameter; hence no such fluid pressure seal is formed by O-rings 61 in the fully stroked configuration depicted in FIGS. 7A and 7B.

As the power charge gas further expands, the force generated by fluid pressure acting on piston surface 34 causes said at least one shear screw 25 to separate, thereby releasing the locking engagement of said shear screw 25 against shoulder 17*a* of radial extension 17 and allowing downward movement of upper sleeve member 30 and attached lower sleeve member 40. Such downward movement starts the setting process of the downhole tool by forcing the outer components downward while the inner components remain stationary.

After tension mandrel adapter 90 enters bore 41 of the lower pressure sleeve member 40, the fluid bypass area (that is, the flow path formed by the annular space between the outer surface of the mandrel adapter 90 and the inner surface of bore 41 of lower sleeve member 40 is greatly reduced which acts as a mechanism to further regulate the setting stroke. As the power charge burns completely, the setting tool will reach its maximum stroke length; at this point, the downhole tool is completely set and released from setting tool 100. Cushion 91 absorbs impact force between lower surface 33 of upper sleeve member 30 and tension mandrel adapter 90, preventing damage from repeated impacts from multiple setting iterations. Outer components (upper sleeve member 30 and lower sleeve member 40 are then free to stroke completely and reach a bleed off position.

After the stroke of setting tool 100 is complete, seals 60 reach the top of the upper pressure sleeve 30 which causes them to come off seat and allow the remaining gas pressure to bleed off. Also, seals 61 are permitted to reach the bottom of the tension mandrel 70; because the lower portion of said mandrel 70 has a smaller outer diameter than the upper portion of said mandrel 70, O-rings 61 no longer engage against said outer surface 76 of mandrel 70 (or form a fluid pressure seal) in said stroked portion. As a result, the fluid pressure seal formed by said O-rings 61 is released, thereby permitting any remaining fluid pressure to bleed off. Put another way, when setting tool 100 is in the fully stroked position, both sets of integral O-rings 60 and 61 are unseated, which guarantees bleed off of any internal pressure downhole. Furthermore, when setting tool 100 is in the fully stroked position, said O-rings 60 are all visible, thereby allowing users have positive visual confirmation that setting tool 100 has been fully stroked from a safe distance.

Setting tool 100 can then be retrieved from a wellbore and can be redressed to be run again. In a preferred embodiment, it is to be observed that the dampening assembly of the present invention (typically comprising internal plug 50, ball 29 and dampening material or media such as grease or other highly viscous fluid) can be separately removed from setting tool 100 of the present invention, and replaced as a separate modular and pre-loaded component to facilitate quick, efficient and cost effective redressing of setting tool 100.

Setting tool 100 of the present invention greatly reduces the chances of unintended or inadvertent pre-setting. Shear screw(s) 25 are sized so that pulling on setting tool 100 with wireline cannot stroke the tool. A conventional wireline rope socket is weaker than said shear screw 25 or the sum of said shear screws' shear value; if setting tool 100 becomes stuck within a wellbore, the rope socket (weak point) will separate before setting tool 100 will stroke.

Additionally, the piston area of setting tool 100 is designed so that said setting tool will flood with wellbore fluids in the event of a catastrophic O-ring leak. Any pressure downhole would be balanced across the piston area, meaning that wellbore pressure cannot inadvertently stroke setting tool 100 (unlike conventional setting tools which can inadvertently stroke and if wellbore pressure enters the tool above the pistons).

Top and bottom connections of setting tool 100 are designed to plug directly into industry standard wireline equipment (i.e. firing head and wireline adapter kits for plugs). The structure, attachment, and use of both the firing head and the setting adapter (which are commercially available) is understood by those in the art and, for clarity and conciseness, is not described in detail in this disclosure. Setting tool 100 is more rigid than conventional setting tools in order to make the setting tool of the present invention less susceptible to bending when running into deviated wellbores.

Windows or apertures 44 in the lower pressure sleeve 40 allow easy access to wireline adapter kit set screws when the setting tool 100 is in the stroked position, thereby expediting the teardown process. Ports in the tension mandrel adapter allow wellbore pressure to enter the orifice above a ball on seat which helps to keep the ball in place upon release from the frac plug. Conventional tools without this feature tend to "suck" the ball off seat when the tool releases.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed is:

1. A gas operated tool for setting a downhole device in a wellbore, the tool comprising:

a pressure sub having a first end, a second end, and an inner chamber defining a volume, wherein the inner chamber is configured to receive a power charge;

a mandrel operationally attached to the second end of the pressure sub;

a setting sleeve slidably disposed on the mandrel, wherein the setting sleeve is configured to alternate between a first running position and a second setting position when axial force is applied to the setting sleeve; and a dampening assembly coupled to the setting sleeve, wherein the dampening assembly is configured to regulate the axial force applied to the setting sleeve, wherein the dampening assembly comprises:

a housing having an aperture and defining an inner space;

dampening material disposed within the inner space; and a plug configured to prevent the dampening material from flowing through the aperture toward the pressure sub, while allowing gas generated by combustion of the power charge to pass through the aperture toward the setting sleeve.

2. The tool of claim 1, wherein the dampening material comprises grease or other flowable fluid.

3. The tool of claim 1, wherein the power charge is configured to generate a gas pressure in the inner chamber that applies a force to the dampening material, and wherein the dampening material is configured to apply a force to a piston surface of the setting sleeve in response to the force applied to the dampening material by the gas pressure.

4. The tool of claim 1, wherein the setting sleeve is secured in the first running position with at least one separatable member.

5. The tool of claim 4, wherein the at least separatable member comprises a shear screw, a shear pin, or a shear ring.

6. The tool of claim 3, wherein the force applied to the piston surface of the setting sleeve by the dampening material causes the setting sleeve to shift from the first running position to the second setting position.

7. The tool of claim 1, wherein the volume of the inner chamber ranges from 14.5 to 17.5 cubic inches.

8. The tool of claim 1, wherein the volume of the inner chamber ranges from 19.5 to 26.5 cubic inches.

9. The tool of claim 1, wherein the power charge contains an amount of an explosive in a range between 350 grams and 470 grams.

10. The tool of claim 1, wherein the power charge contains an amount of an explosive in a range between 440 grams and 480 grams.

11. A method for setting a downhole device in a wellbore, the method comprising:

providing a setting tool comprising:

a pressure sub having a first end, a second end, and an inner chamber defining a volume, wherein a power charge is disposed in the inner chamber;

a mandrel operationally attached to the second end of the pressure sub;

a setting sleeve slidably disposed on the mandrel, wherein the setting sleeve is configured to alternate between a first running position and a second setting position when axial force is applied to the setting sleeve; and a dampening assembly coupled to the setting sleeve, wherein the dampening assembly is configured to regulate the axial force applied to the setting sleeve, wherein the dampening assembly comprises:

a housing having an aperture and defining an inner space;

dampening material disposed within the inner space; and a plug configured to prevent the dampening material from flowing through the aperture toward the pressure sub, while allowing gas generated by combustion of the power charge to pass through the aperture toward the setting sleeve;

positioning the setting tool and the downhole device within the wellbore;

selectively igniting the power charge in the inner chamber of the pressure sub to generate gas;

setting the downhole device in the wellbore in response to ignition of the power charge; and retrieving the setting tool from the wellbore after setting the downhole device in the wellbore.

12. The method of claim 11, wherein the dampening material comprises grease or other flowable fluid.

13. The method of claim 11, wherein the gas applies force to the dampening material, and wherein the dampening material applies force to a piston surface of the setting sleeve.

14. The method of claim 11, wherein the setting sleeve is secured in the first running position using at least one separatable member.

15. The method of claim 11, wherein the volume of the inner chamber ranges from 14.5 to 17.5 cubic inches.

16. The method of claim 11, wherein the volume of the inner chamber ranges from 19.5 to 26.5 cubic inches.

17. The method of claim 11, wherein the power charge contains an amount of explosive in a range between 350 grams and 470 grams.

18. The method of claim 11, wherein the power charge contains an amount of explosive in a range between 440 grams and 480 grams.

19. An apparatus for setting a downhole plug in a wellbore, the apparatus comprising:

a pressure sub having a first end, a second end, and an inner chamber defining a volume, wherein the inner chamber is configured to receive a power charge, and wherein the power charge is configured to generate pressurized gas;

a mandrel coupled to the second end of the pressure sub;

a setting sleeve having an upper end, a lower end, and a central bore extending from the upper end to the lower end, wherein the mandrel is disposed within the central bore of the setting sleeve, and wherein gas pressure from the pressurized gas generated by the power charge is configured to cause the relative positioning of the setting sleeve and the mandrel to shift from a first running position to a second setting position;

an upper sealing member disposed between the setting sleeve and the mandrel, wherein the gas pressure is sealed by the upper sealing member in the first running position but the gas pressure is not sealed by the sealing member in the second setting position, and wherein a portion of the gas pressure bleeds off at the upper end of the setting sleeve in the second setting position; and a lower sealing member disposed between the setting sleeve and the mandrel, wherein the gas pressure is sealed by the lower sealing member in the first running position but the gas pressure is not sealed by the sealing member in the second setting position, and wherein a portion of the gas pressure bleeds off at the lower end of the setting sleeve in the second setting position; and a dampening assembly coupled to the setting sleeve and configured to regulate the axial force applied to the setting sleeve, wherein the dampening assembly comprises:

a housing having an aperture and defining an inner space;

dampening material disposed within the inner space; and a plug moveably disposed within the inner space.

20. The apparatus of claim 19, wherein the upper sealing member contacts both the setting sleeve and the mandrel to form a fluid pressure seal in the first running position, and wherein the lower sealing member contacts both the setting sleeve and the mandrel to form a fluid pressure seal in the first running position.

21. The apparatus of claim 19, wherein the upper sealing member does not contact both the setting sleeve and the mandrel in the second setting position, and wherein the lower sealing member does not contact both the setting sleeve and the mandrel in the second setting position.

22. The apparatus of claim 21, wherein the mandrel has a first outer diameter and a second outer diameter that is smaller than the first outer diameter, and wherein the second outer diameter of the mandrel is aligned with, but does not contact, the upper lower sealing member and the second sealing member in the second setting position.

23. The apparatus of claim 19, wherein the volume of the inner chamber ranges from 14.5 to 17.5 cubic inches.

24. The apparatus of claim 19, wherein the volume of the inner chamber ranges from 19.5 to 26.5 cubic inches.

25. The apparatus of claim 19, wherein the power charge contains an amount of explosive in a range between 350 grams and 470 grams.

26. The apparatus of claim 19, wherein the power charge contains an amount of explosive in a range between 440 grams and 480 grams.

27. A method for setting a downhole device in a wellbore, the method comprising:

providing a setting tool comprising:

a pressure sub having a first end, a second end, and an inner chamber defining a volume, a power charge disposed in the inner chamber;

a mandrel coupled to the second end of the pressure sub;

a setting sleeve having an upper end, a lower end, and a central bore, wherein the mandrel is disposed within the central bore;

an upper sealing member disposed between the setting sleeve and the mandrel;

a lower sealing member disposed between the setting sleeve and the mandrel;

a dampening assembly coupled to the setting sleeve and configured to regulate the axial force applied to the setting sleeve, wherein the dampening assembly comprises:

a housing having an aperture and defining an inner space;

ii) dampening material disposed within the inner space; and a plug moveably disposed within the inner space;

selectively igniting the power charge in the inner chamber of the pressure sub to generate pressurized gas in the inner chamber;

shifting the relative positioning of the setting sleeve and the mandrel from a first running position to a second setting position, wherein the gas pressure from the pressurized gas is sealed by the upper sealing member and the lower sealing member in the first running position, but gas pressure from the pressurized gas is not sealed by the upper sealing member and the lower sealing member in the second setting position;

bleeding off a first portion of the gas pressure at the upper end of the setting sleeve; and bleeding off a second portion of the gas pressure at the lower end of the setting sleeve.

28. The method of claim 27, wherein the upper sealing member contacts both the setting sleeve and the mandrel in the first running position, and wherein the lower sealing member contacts both the setting sleeve and the mandrel in the first running position.

29. The method of claim 27, wherein the upper sealing member does not contact both the setting sleeve and the mandrel in the second setting position, and wherein the lower sealing member does not contact both the setting sleeve and the mandrel in the second setting position.

30. The method of claim 29, wherein gas pressure bleeds off through a first gap formed between the mandrel and the upper sealing member in the second running portion, and wherein gas pressure bleeds off through a second gap formed between the mandrel and the lower sealing member in the second running portion.

31. The method of claim 27, further comprising the steps of:

setting the downhole device in the wellbore; and retrieving the setting tool from the wellbore.

32. The method of claim 27, wherein the volume of the inner chamber is ranges from 14.5 to 17.5 cubic inches.

33. The method of claim 27, wherein the volume of the inner chamber is ranges from 19.5 to 26.5 cubic inches.

34. The method of claim 27, wherein the power charge contains an amount of explosive in a range between 350 grams and 470 grams.

35. The method of claim 27, wherein the power charge contains an amount of explosive in a range between 440 grams and 480 grams.

* * * * *